US008455781B2

(12) United States Patent
Curnis et al.

(10) Patent No.: US 8,455,781 B2
(45) Date of Patent: Jun. 4, 2013

(54) LOW-VOLTAGE CIRCUIT BREAKER WITH SEALED INTERCHANGEABLE POLES

(75) Inventors: Maurizio Curnis, Carvico (IT); Federico Gamba, Bergamo (IT)

(73) Assignee: ABB S.p.A., Milan (IT)

( * ) Notice: Subject to any disclaimer, the term of this patent is extended or adjusted under 35 U.S.C. 154(b) by 768 days.

(21) Appl. No.: 11/868,128

(22) Filed: Oct. 5, 2007

(65) Prior Publication Data

US 2008/0245642 A1 Oct. 9, 2008

(30) Foreign Application Priority Data

Oct. 6, 2006 (IT) ..... BG2006A0051

(51) Int. Cl.
*H01H 9/02* (2006.01)

(52) U.S. Cl.
USPC ..... 218/154; 218/7; 200/17 R

(58) Field of Classification Search
USPC .... 218/2–7, 14, 118, 140, 152–154; 200/400, 200/401; 335/6–16, 131, 132, 167–176
See application file for complete search history.

(56) References Cited

U.S. PATENT DOCUMENTS 4,484,164 A * 11/1984 McClellan et al. ..... 335/16
5,521,348 A 5/1996 Berndt et al.
5,628,394 A * 5/1997 Benke et al. ..... 200/400
6,541,727 B2 * 4/2003 Beck et al. ..... 218/140
6,930,271 B1 8/2005 Palmieri et al.

FOREIGN PATENT DOCUMENTS

| | | |
|---|---|---|
| CN | 2577457 Y | 10/2003 |
| DE | 4210716 | 9/1993 |
| EP | 0 859 387 | 8/1998 |
| FR | 2706675 | 12/1994 |
| FR | 2848332 | 6/2004 |

OTHER PUBLICATIONS

Extended European Search Report issued in related European Application No. 07116273.9 on Feb. 1, 2008.

* cited by examiner

*Primary Examiner* — Tulsidas C Patel
*Assistant Examiner* — Marina Fishman
(74) *Attorney, Agent, or Firm* — Novak Druce Connolly Bove + Quigg LLP

(57) ABSTRACT

A low-voltage circuit breaker that comprises: a containment structure; a control mechanism; a plurality of circuit breaking poles, each of which comprises a housing containing a sealed ampoule that in turn contains at least one fixed contact and at least one moving contact, which can be mutually coupled and uncoupled, said housing consisting of a first side and a second side that define an interior containing said ampoule, the outer side wall on said first side being complementary to and associable with the outer side wall of said second side, said poles being located side-by-side to form a set of poles complementary to at least a part of said containment structure; operative connection means between said control mechanism and said poles.

7 Claims, 9 Drawing Sheets

LOW-VOLTAGE CIRCUIT BREAKER WITH SEALED INTERCHANGEABLE POLES

FIELD OF THE INVENTION

The present invention relates to a low-voltage circuit breaker with sealed poles that has improved characteristics of interchangeability of the current interrupting means, more compact and modular features, and also an easier maintenance and a greater flexibility in terms of its performance.

The term low-voltage circuit breaker is used equally to refer to both the so-called circuit breaker isolators and the automatic circuit breakers, the latter being devices for interrupting the electrical current that include safety devices that automatically open the contacts in the event of certain conditions of overload, short circuit or other electrical anomalies. In the description that follows, the term circuit breaker is consequently used to mean either an automatic circuit breaker or any other type of single-pole or multipole, low-voltage circuit breaking device (e.g. an isolator).

BACKGROUND OF THE INVENTION

It is common knowledge that each of the electrical poles of a circuit breaker comprises at least two electrodes for connecting to an electrical network and current interrupting means. Each of said current interrupting means comprises at least a pair of contacts suitable for acquiring at least two configurations, i.e. coupled and uncoupled.

The circuit breakers also comprise control means, hereinafter indicated for the sake of brevity by the term control, that establish the mutual coupling and uncoupling of said current interrupting means.

The control comprises propulsion means, such as springs or magnets, that provide the energy needed to couple and uncouple the current interrupting means in the poles, according to the methods required. In addition to the propulsion means, the control can comprise suitable control and drive kinematic chains (particularly shafts and/or sliding members, and/or connecting rods) placed between the propulsion means and the moving contacts of the respective poles.

The installer normally chooses a circuit breaker to suit the particular features of the loads and of the stretch of electrical network for which it is intended, using suitable calculations to formulate a set of performance requirements to be met. That is why manufacturers produce families of devices including various sizes, each of which is suitable for covering a particular range of characteristics.

The most common requirements for a circuit breaker can be summarised, using definitions known to a person skilled in the art, in the form of the so-called nameplate data or "specifications". The following are normally considered among the requirements for a circuit breaker: rated voltage (Ue), rated impulse withstand voltage (Uimp), rated current (Iu), breaking capacity in various conditions (Icu, Ics, Icw), making capacity (Icm), mechanical life, allowable frequency of operation, electrical endurance in standard conditions, proportional loss of electrical endurance after a short circuit, electrodynamic limiting capacity, insulation between the phases, etc.

The circuit breaker's performance depends on the combination of the characteristics of its constituent parts and particularly on those of the control and electric poles. The control provides the energy for contact opening and closing operations according to previously established methods, while the electrical poles—which include the contacts—are the essential means for creating and interrupting the current.

Much research has been done to improve the characteristics of the controls and electrical poles, both individually and as a whole. As a consequence, there are several varieties of said elements available today, each of which is characterised by specific advantages and disadvantages.

In particular, the manufacturer optimises and exploits the technologies available to produce families and sizes of circuit breakers capable of adequately covering the various performance combinations required for the various types of installation.

It is naturally impossible to have specific circuit breakers tailored to every particular performance combination required. Generally speaking, circuit breakers are chosen that have a slightly better performance than is strictly necessary, taking action to reduce or down-rate them where necessary (using a different calibration of the relays and current sensors, for instance). As it is easy to imagine, this procedure is fine for a modest down-rating, but it would not be cost effective to use appliances that are considerably over-dimensioned for the predicted real needs.

The known types of electrical pole are classifiable in at least two main families, which have become well established, i.e. the poles in free air and the so-called sealed poles, which have to be contained in a specific controlled environment.

The poles in free air are commonly used in moulded-case (MCCB) and air (ACB) circuit breaker devices and are characterised by the presence of the so-called arcing chambers in the vicinity of the contacts. The arcing chambers place the area occupied by the active part of the contacts (where the electric current is created and interrupted) more or less directly in communication with the outside environment. See, for instance, EP0859387. The arcing chambers can comprise a variety of additional elements, described in more detail below. The poles in free air come in versions with single or multiple (e.g. double) current interrupting capabilities. The way in which the contacts move may also vary, being rotatory, translatory or a combination of the two.

The sealed poles are commonly used in high-voltage devices and are normally characterised by the presence of sealed ampoules or chambers surrounding the area of the contacts (where the electrical current is created and interrupted), preventing any free communication between the contacts and the outside environment. Sealed poles are also classifiable in two categories. The first type comprises the so-called vacuum poles, which operate in a severely rarefied atmosphere consisting of known gases; the second type comprises poles in an arc-extinguishing gas, in which case the sealed chamber contains specific gases or gaseous mixtures at a known pressure. Unlike the poles in free air, the sealed poles do not have channels directly communicating with the outside environment, which would be incompatible with their characteristics of air tightness.

It is easy to imagine that the presence or absence of a normal atmosphere in the contact area for the free-air or sealed types of pole gives rise to very different operating conditions.

In particular, the poles in free air must be designed particularly so that they avoid facilitating the formation and so that they instead facilitate the extinction of any electrical and plasma arcs that are well known to be supported by the presence of oxygen and other gases commonly occurring in the normal atmosphere. For this purpose, to ensure the proper operation of the poles in free air, especially when it comes to interrupting high currents, a considerable gap (or extended stroke) must be rapidly created between the active areas of the contacts. Other known optional devices, such as deflectors, foils, filters and gasifying means, can be connected to the arcing chamber to help extinguish the electrical arc, e.g. by diverting the arc towards the areas far from the contacts, absorbing thermal energy, and facilitating the de-ionisation of the plasma and the outflow of gases and filtrates from the circuit breaker, after their residual aggressiveness has been reduced as far as possible.

Given the substantial absence of air or ionisable gases in the area of the contacts, sealed poles operate in very different conditions. In fact, this situation determines a more or less marked immunity to the formation of electrical arcs in the area where the electrical current is interrupted, even when high currents are interrupted are during short circuits, offering the advantage of a perfect operation even with relatively small displacements between the contacts (i.e. a reduced stroke). On the other hand, for sealed poles it is essential to guarantee that the controlled environment (the positive or negative relative pressure tightness) is maintained. Sealed poles also have the advantage of producing virtually no ionised gas emissions or high temperatures in the outside environment, thereby substantially preventing any risk of fire or contamination of the surrounding environment or other parts or accessories of the circuit breaker or other equipment in the vicinity (e.g. the electric switchboard containing the breaker, or other devices installed on the board).

Specifically to support the above-described different electrical and physical principles, which distinguish the operation of circuit breakers with poles in air from that of circuit breakers with sealed poles, and particularly the different needs concerning the relative displacement between the contacts in the closed and open (or tripped) positions, two separate families of controls have also been developed and become well-established, i.e. the so-called controls for poles in free air and the so-called controls for sealed poles. In particular, the controls for poles in free air are of the so-called extended-stroke type, while the controls for use with sealed poles are of the so-called reduced-stroke type.

The most obvious difference between these two types of control consists in the different extent of the stroke that they must impose on the moving contacts in order to complete a circuit breaking operation. Said stroke is normally induced by the combined movement of a main shaft and a suitable intermediate operative connection member (e.g. a connecting rod) between the shaft and the moving contacts.

It is important to note, however, that the category of sealed poles includes different structural designs that can entail far from negligible differences, for instance in the parameters of the moving contact's stroke (which may be more or less extended), and/or the way in which the moving contact is operated (for instance by means of a cam under pressure or a hinged pin), and/or in the overall dimensions.

As a result, even among circuit breakers based on the use of sealed poles, it may be of fundamental importance to choose between different elements for the kinematic chain comprising the control and the related means for its operative connection to the poles.

In short, the control must be compatible with the constraints and demands relating to the kinematic, dynamic, energetic and dielectric isolation features that, depending on the type of pole chosen, may differ in each case, and may even be in contrast with one another.

The poles and the control generally constitute the most important and noble parts of a circuit breakers and must be perfectly compatible with one another. The synergy required between these two elements has led manufacturers to design and manufacture circuit breakers with different types of pole in completely separate, specialised processes. This need for separation explains why manufacturers have traditionally foregone the chance to exploit even the marginal compatibility of the less noble and characteristic parts of a circuit breaker (such as the outer case, the accessories and the safety devices) in favour of a complete specificity of all the parts concerned.

In short, if a manufacturer wishes to produce ranges of circuit breakers based on different types of pole—in order for instance to cover not only a wide range of certain specifications, but also different combinations of these specifications—then, according to the state of the art, the manufacturer is practically obliged to give up any opportunities to standardise the component parts.

In particular, there are no devices available based on the use of different types of sealed pole that offer any appreciable degree of mutual interchangeability between their component parts.

This manufacturing inflexibility is unavoidably translated into the practical need, for the manufacturer, to have separate design resources, technologies and production lines for the two types of circuit breaker, ultimately giving rise to economic costs that cannot fail to have a fallout on the final cost of the devices.

In addition to the economic problem, there is also a practical fallout for users of the two types of device, who are obliged to use separate ranges of parts for both families of equipment.

SUMMARY OF THE INVENTION

The main technical aim of the present invention is to realise a circuit breaker that enables the above-described drawbacks to be overcome.

As part of this technical aim, one object of the present invention is to realise a circuit breaker with sealed poles that has improved characteristics for the purposes of industrial manufacturing standardisation.

Another object of the present invention is to realise a circuit breaker with sealed poles that can be used with a standard control while also ensuring complete compatibility with the so-called electrical poles in free air.

Another object of the present invention is to realise a circuit breaker with sealed poles in which the operative connection between the control and the poles is achieved by simple mechanical means.

Another object of the present invention is to realise a circuit breaker with sealed poles that comprises a limited number of parts, and that is easy to assemble and install.

Another object of the present invention is to realise a circuit breaker with sealed poles the component parts of which are easy to inspect without any complex servicing procedures.

Another object of the present invention is to realise a circuit breaker with sealed poles that is easily converted into an air circuit breaker by replacing a very limited number of parts.

Another object of the present invention is to realise a circuit breaker with sealed poles that enables considerable design, engineering and manufacturing synergies to be achieved with considerable consequent reductions in the manufacturing costs.

Another, not necessarily last object of the present invention is to realise a circuit breaker with sealed poles that is highly reliable and relatively easy to manufacture at a competitive cost.

Said technical aim and objects, as well as any other objects that emerge from the description that follows, are achieved by a low-voltage circuit breaker that comprises:

a containment structure:

a control mechanism;

a plurality of circuit breaking poles, each of which comprises a housing containing a sealed ampoule that in turn contains at least one fixed contact and at least one moving contact, which can be mutually coupled and uncoupled, said housing consisting of a first side and a second side that define an interior containing said ampoule, the outer side wall on said first side being complementary to and associable with the outer side wall of said second side, said poles being located side-by-side to form a set of poles complementary to at least a part of said containment structure;

operative connection means between said control mechanism and said poles.

Thanks to its particular structural design, the circuit breaker according to the invention enables the problems typical of the circuit breakers of the known state of the art to be overcome. In particular, the construction is extremely compact and flexible, in the sense that it easily enables the characteristics of the circuit breaker to be varied simply by replacing the poles and entirely or partially replacing the kinematic coupling between the control mechanism and the poles. Of course, there is nothing to prevent action also being taken on other parts of the circuit breaker to make any changes required, e.g. substituting or integrating the propulsion members and/or electronic parts.

Additional characteristics and advantages of the invention will emerge from the following description of preferred embodiments of a circuit breaker according to the invention, of which non-limiting examples are given in the attached drawings.

DESCRIPTION OF THE PREFERRED EMBODIMENTS

Figure 1:
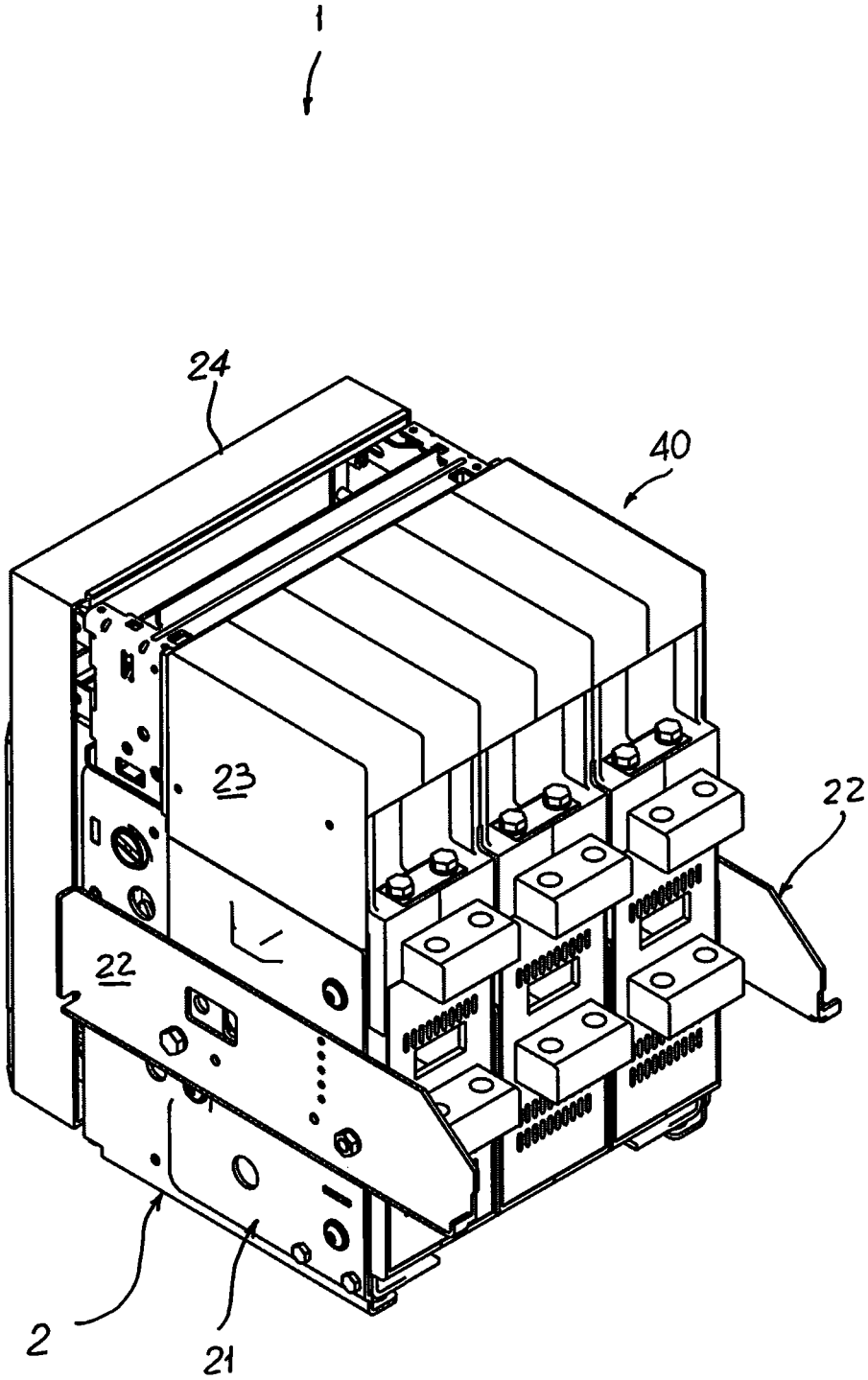
FIG. 1 is a perspective view of an assembled circuit breaker according to the invention.

With reference to the attached figures, the low-voltage circuit breaker 1 according to the invention comprises a containment structure 2, with, for instance, sides, elements for closing the structure and elements for interfacing with the outside 21, 22, 23, as well as a front panel 24. The circuit breaker 1 also comprises a control mechanism or control means 3 and a plurality of circuit breaking poles 4.

One of the characteristic features of the circuit breaker according to the invention is that each of said poles comprises a first housing 41 containing a sealed ampoule 5. At least one fixed contact and at least one moving contact (not shown in the attached figures), which can be mutually coupled and uncoupled, are contained inside said sealed ampoule.

The housing 41 comprises a first side 410 and a second side 420, which define an interior 430, that contains said ampoule 5. The housings 41 are modular and complementary to and associable with one another in a compact manner. In other words, the outer side wall of said first side 410 is complementary to and associable with the outer side wall of said second side 420 and the poles 4 lie side-by-side so as to form an extremely compact set of poles 40. In turn, the set of poles 40 is complementary to at least a part of said containment structure 2.

Finally, the circuit breaker 1 also comprises means 6 for operatively connecting said control mechanism 3 and said poles 4. The structure and characteristics of the operative connection means are described in more detail below.

The circuit breaker according to the invention thus consists of a set of modular elements that are easy to assemble and replaceable. In fact, thanks to the modular nature of the poles and to the standardisation of the components, the assembly of the circuit breaker 1 according to the invention is particularly straightforward. The term modular is used here to mean that the structural design of the poles, irrespective of their current interrupting characteristics, which are also determined by the type of ampoule used, are substantially standardised in terms of their shape, overall dimensions and interfacing with other parts inside and outside the circuit breaker.

The housing 41 is preferably made of an insulating material and the operative connection means 6 comprise at least one element made of an insulating material.

The characteristics of the sealed ampoule 5 may vary depending on the needs of the application. For instance, the sealed ampoule may be of the so-called vacuum type or it may contain an arc-extinguishing gas, or a mixture of such gases, of known type.

Figure 2:
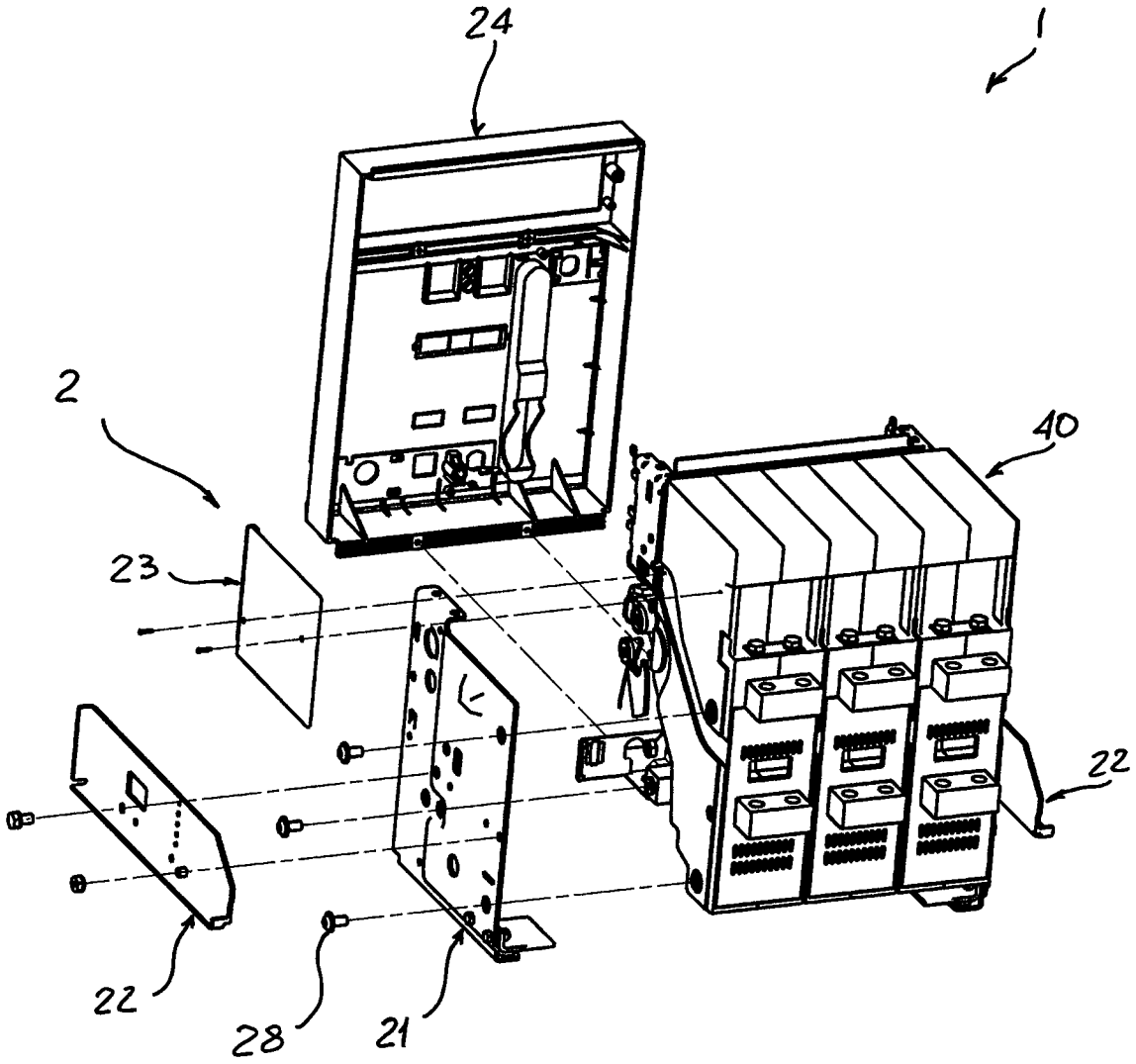
FIG. 2 is a partially exploded perspective view of a circuit breaker according to the invention.

As shown in FIGS. 1 and 2, the containment structure 2 comprises at least two sides 21 that are complementary with the surfaces of the two opposite sides of said set of poles 40; the sides 21 are associated with the set of poles 40 and the assembly is completed with fixing means lying crosswise to the opposite lateral surfaces of the set of poles.

Figure 4:
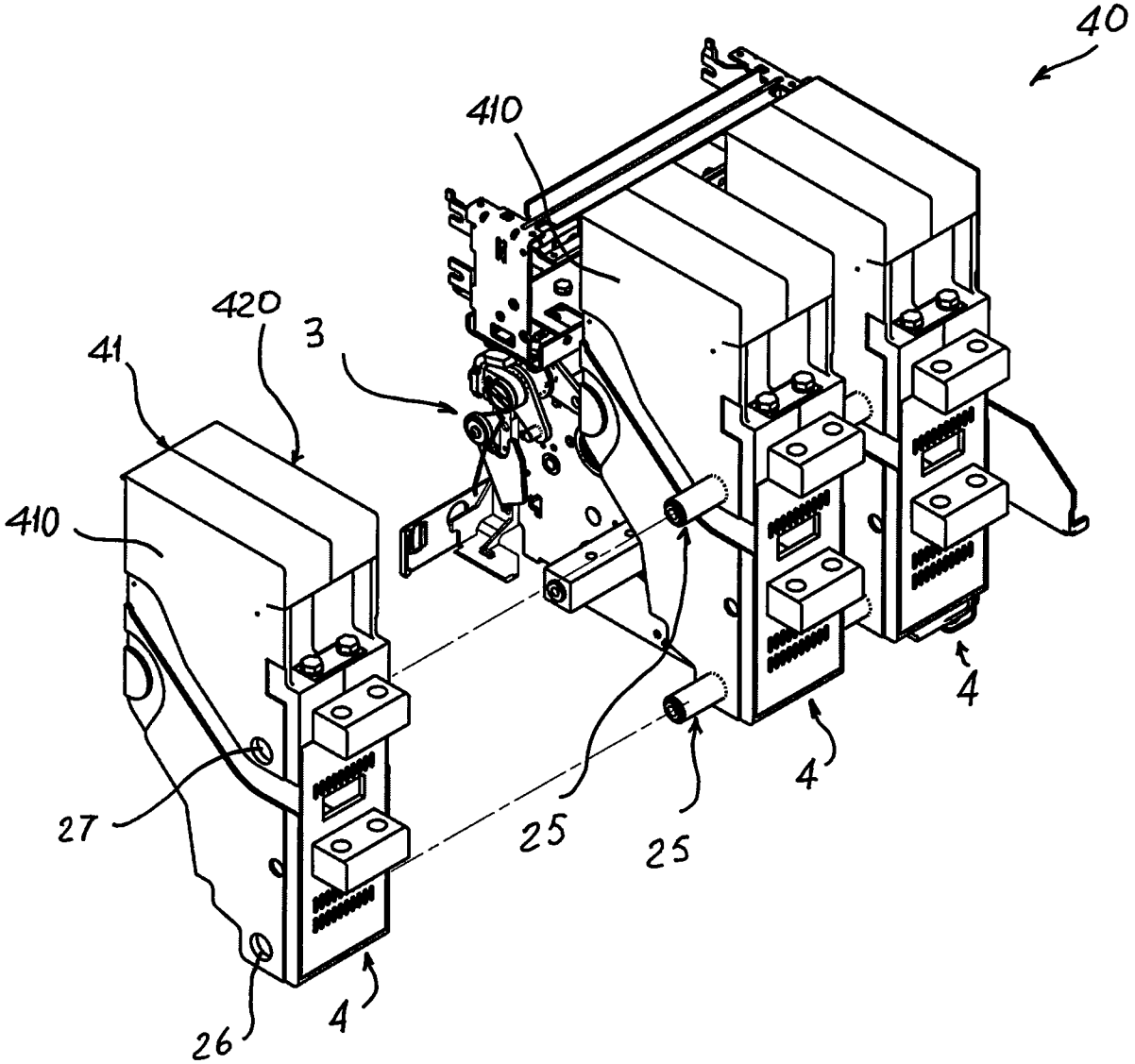
FIG. 4 is a partially exploded perspective view of several details of a circuit breaker according to the invention.

The fixing means may, for instance, comprise one or more crosswise ties 25 (see FIG. 4) that cross over the poles in line with one or more through holes 26, 27. The assembly can be completed, for instance, with screwing means 28 that engage in threaded ends of the ties 25, thus achieving a straightforward, solid and compact structure.

The control means 3 are not described in detail here because they can be of the conventional type. However, with reference to FIGS. 5, 6, 8 and 9, the control means 3 preferably comprises a first drive shaft 30 for operatively connecting to said operative connection means 6.

The operative connection means 6 preferably convert the rotatory movement of the drive shaft 30 into a substantially linear translatory movement of the moving contact along a predefined axis 50.

According to particularly preferred embodiments of the circuit breaker according to the invention, illustrated in figures from 5 to 9, the operative connection means 6 comprise, for each pole 4, a drive lever 31 fixed to the drive shaft 30 and operatively connected to the moving contact of the corresponding pole. In other words, the drive shaft 30 and the corresponding drive lever 31 of the control mechanism 3 represent the interface between said control mechanism and the operative connection means 6.

Figure 8:
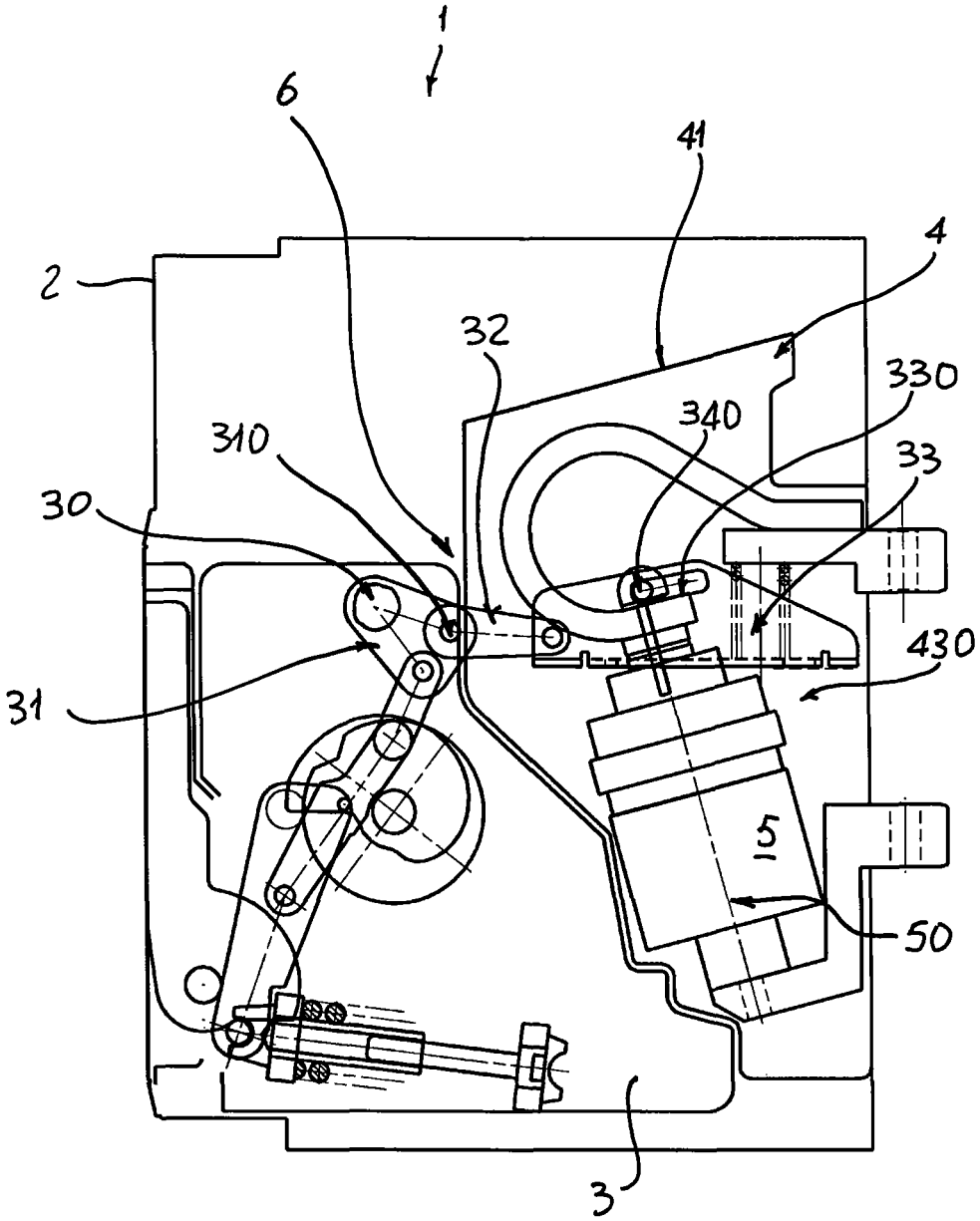
FIG. 8 is a cross-sectional view of a second embodiment of a circuit breaker according to the invention.
Figure 9:
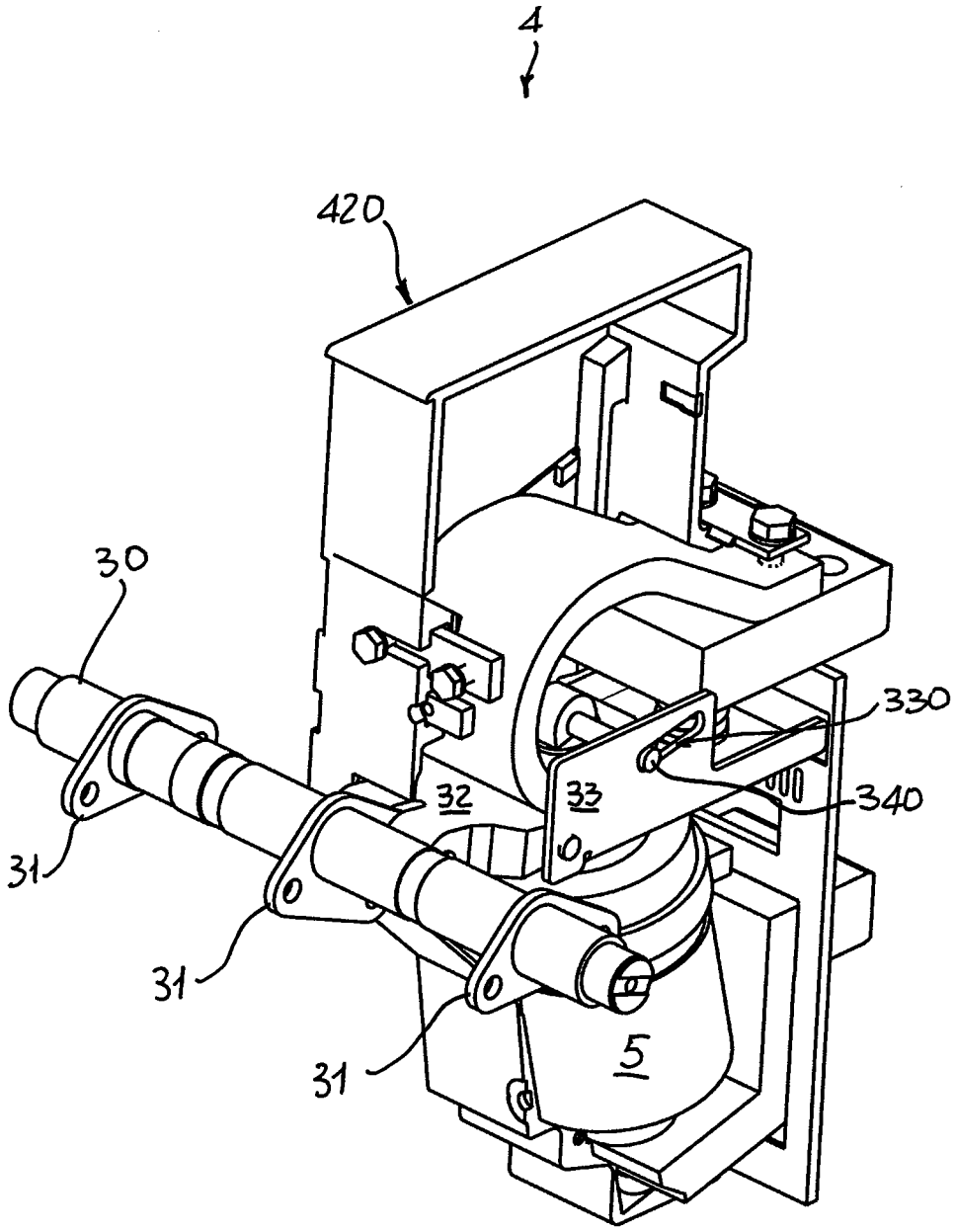
FIG. 9 is a perspective view of the poll and of the kinematic coupling used in the embodiment of the circuit breaker in FIG. 8.

More in detail, with reference to FIGS. 8 and 9, a possible embodiment of the circuit breaker 1 according to the invention comprises a plurality of poles 4, the stylised contours of the housing 41 of which are shown in FIG. 8. The poles 4 are at least partially contained inside the containment structure 2 and each pole comprises at least one fixed contact and one moving contact, not shown in the figure because they are located inside the ampoule 5, suitable for being mutually coupled and uncoupled by means of a translatory movement of the moving contact along the axis 50. A control mechanism 3, of which the essential elements are represented, is also positioned at least partially inside the containment structure 2 and is operatively connected to the pole 4. The control mechanism 3 comprises a drive shaft 30, that is connected—for each pole—to the drive lever 31, that forms the interface with the operative connection means 6.

In the embodiment of the attached FIGS. 8 and 9, said operative connection means 6 comprise a first connecting rod 32 connected to a first connection point 310 on said drive lever 31 and a first carriage 33 for operating said moving contact. Said first carriage 33 preferably comprises a sloping surface 330 operatively coupled to the corresponding moving contact and suitable for converting a translatory movement of said first carriage into a translatory movement of the moving contact along a predefined axis 50.

In practical terms, with reference to FIG. 8, the carriage 33 moves in a substantially horizontal direction under the influence of the connecting rod 32; as a consequence of this displacement, the sloping surface 330, acting on the pin 340 connected to the moving contact, determines the displacement of the moving contact along the axis 50.

Thanks to the modular structure and standardisation of the components, the assembly of the circuit breaker 1 according to the invention is particularly straightforward. In practice, once the containment structure 2, the control mechanism 3, the poles 4 and the operative connection means 6 have been prepared, it is sufficient to position the poles 4 inside the containment structure 2 and to connect the first connecting rod 32 with the first point 310 of the drive lever 30 and, by means of the first carriage 33, with the first moving contact 43, then the circuit breaker is substantially assembled.

Figure 5:
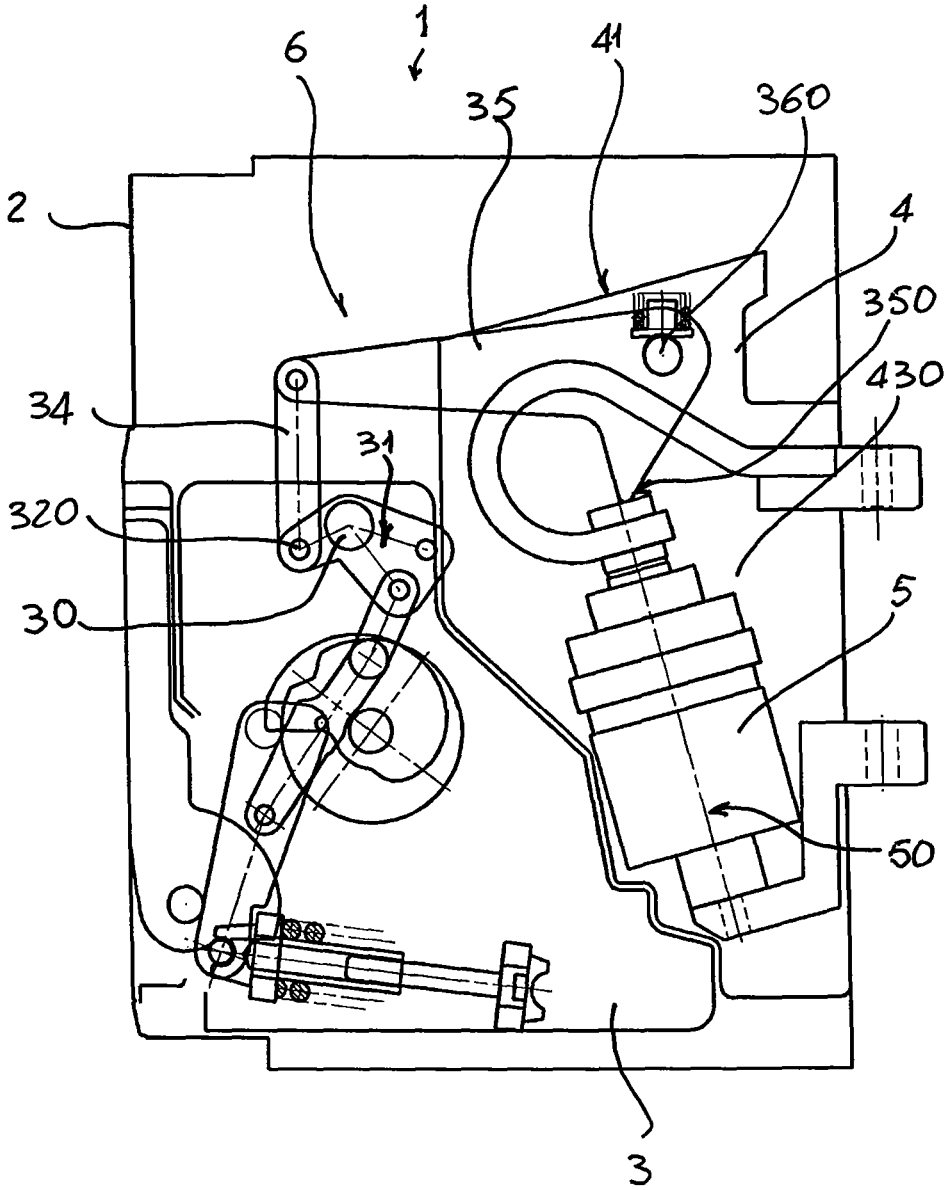
FIG. 5 is a cross-sectional view of a first embodiment of a circuit breaker according to the invention.

According to an alternative embodiment, the circuit breaker 1 according to the invention comprises a plurality of poles, the stylised contours of the housing 41 of which are shown in FIG. 5. The poles 4 are contained at least partially inside the containment structure 2 and each pole comprises at least one fixed contact and one moving contact, not shown in the figure because they are located inside the ampoule 5, suitable for being mutually coupled and uncoupled by means of a translatory movement of the moving contact along the axis 50. A control mechanism 3, of which the essential elements are represented, is also positioned at least partially inside the containment structure 2 and is operatively connected to the pole 4. The control mechanism 3 comprises a drive shaft 30, that is connected—for each pole—to the drive lever 31, that forms the interface with the operative connection means 6.

In the case illustrated, the drive leave 30 comprises a first connection point 310 and a second connection point 320. In practical terms, the operative connection means 6 consist in this case of a second connecting rod 34 connected to the second connection point 320 of the first drive lever 31 and to a second lever 35 of the corresponding moving contact.

The second lever 35 preferably comprises a cam-shaped surface 350 operatively coupled to said moving contact so that the rotation of said second lever 35 around the pin 360 determines a translatory movement of said moving contact along a predefined axis 50. Sprung means 390 are provided that take effect on the lever 35 to ensure the required contact pressure. The fulcrum of the lever 35 is inserted in a slot so that it can swing under the combined effects of the following forces: active (control), passive (moving contact), and inelastic (contact springs).

Different sprung means serving a similar purpose are preferably also provided in the embodiment of FIGS. 8 and 9.

Figure 3:
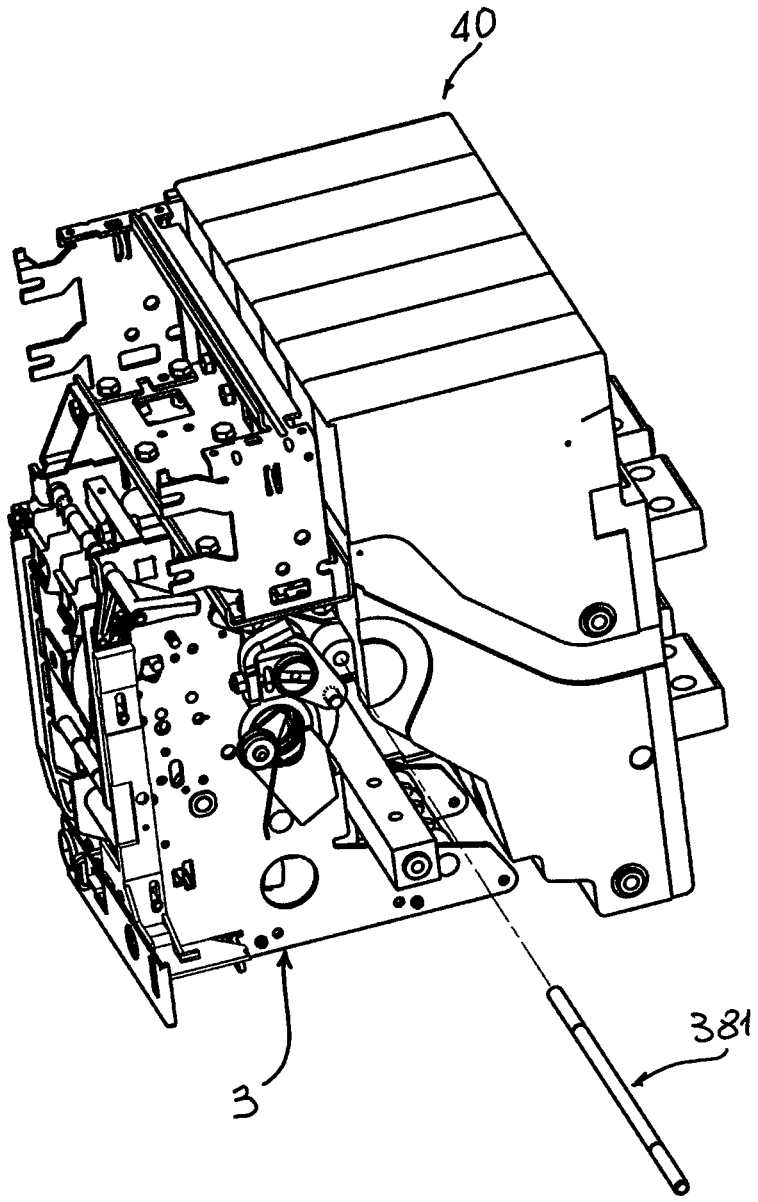
FIG. 3 is a perspective view of several details of a partially assembled circuit breaker according to the invention.

In the various embodiments, the operative connection between the drive shaft 30 and the operative connection means 6 can be achieved by means of a single pin 381 (see FIG. 3), that connects each drive lever 31 with a corresponding connecting rod 32 or 34, or with a pin 380 for each pole (see FIG. 7, for instance) that connects each drive lever 31 with the corresponding connecting rods 32 or 34.

Based on the above description, it is evident that the low-voltage circuit breaker according to the invention achieves the previously stated aims and objects. In fact, the circuit breaker has an extremely compact structure consisting of a limited number of components with standardised characteristics that make it easy to assemble and service.

Figure 6:
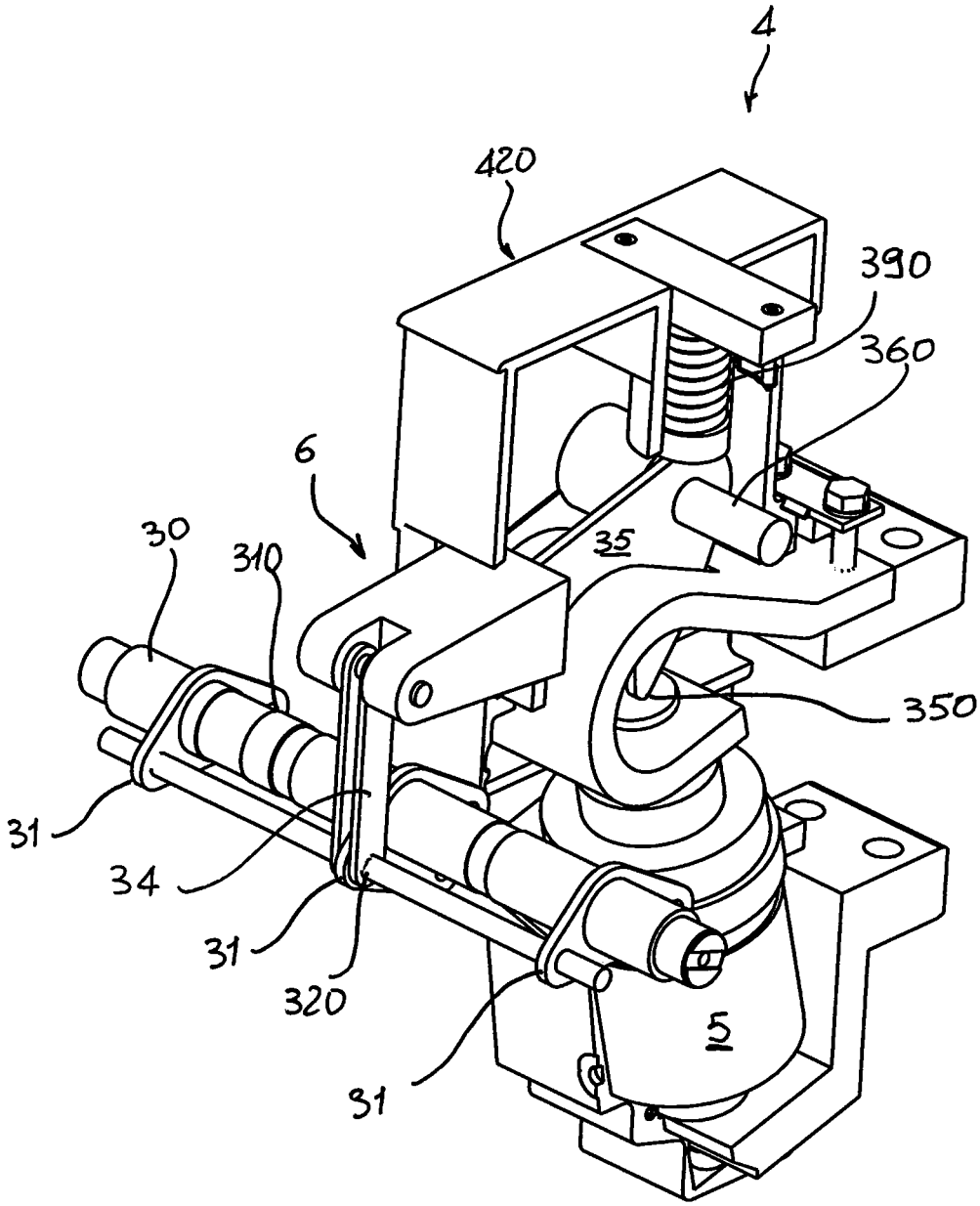
FIG. 6 is a perspective view of the pole and of the kinematic coupling used in the embodiment of the circuit breaker in FIG. 5.
Figure 7:
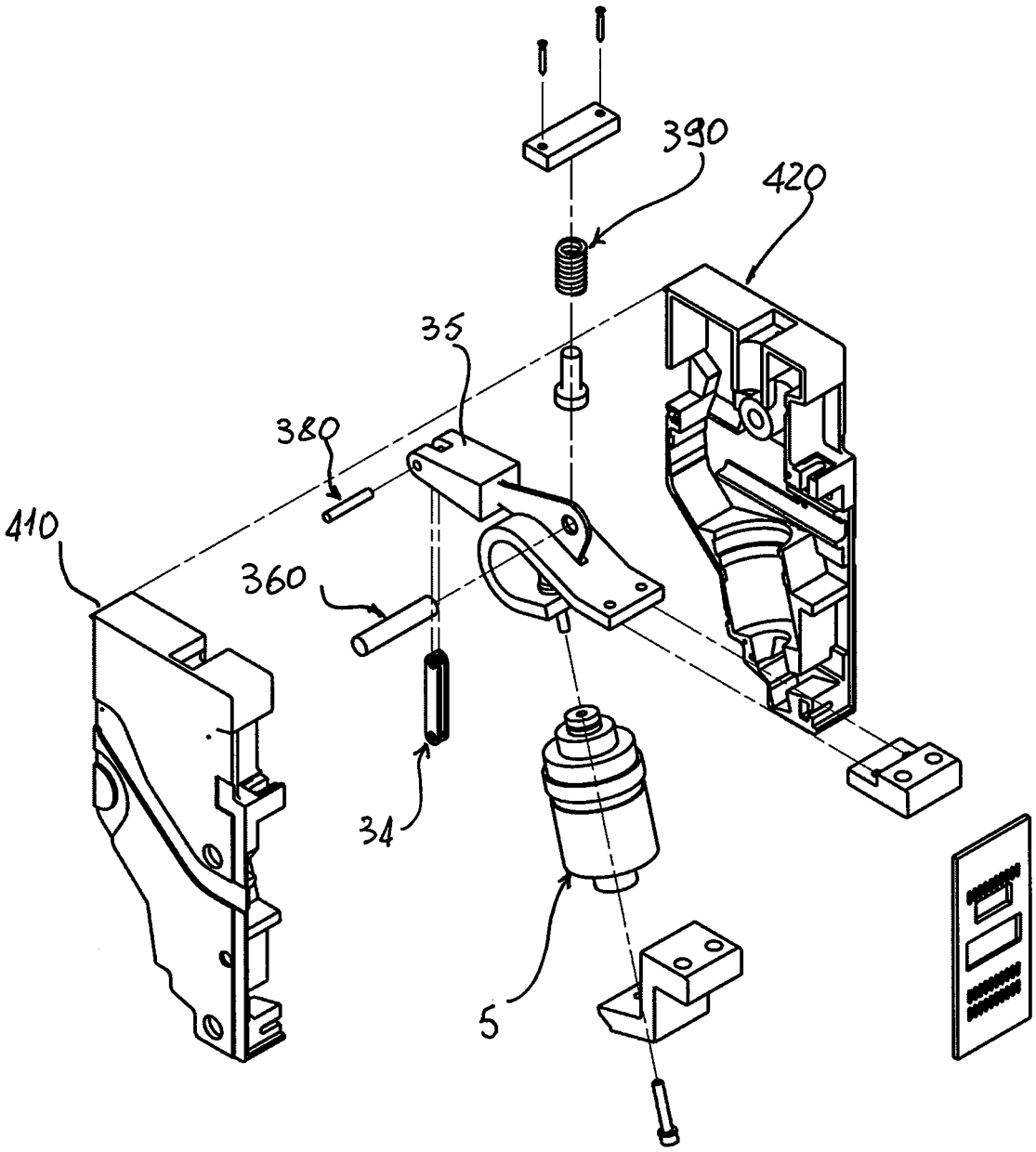
FIG. 7 is a partially exploded perspective view of the pole and of the kinematic coupling used in the embodiment of the circuit breaker in FIG. 5.

Moreover, as emerges from a comparison of the embodiments illustrated, it is extremely easy to replace the poles and kinematic couplings of FIGS. 5-7 with the poles and kinematic couplings of FIGS. 8-9. To switch from the configuration of FIGS. 5-7 to the configuration of FIGS. 8-9, it is only necessary to disconnect the connecting rod 34 from the connection point 320 on the lever 31, substitute the poles and kinematic couplings, then connect the connecting rod 32 to the first point 310 on the drive lever 31 of the control mechanism 3. It is obviously also possible to implement this procedure in reverse.

In the light of the description provided, other characteristics, modifications or improvements are feasible and may be evident to a person skilled in the art. Any such characteristics, modifications and improvements shall consequently be considered part of the present invention. In practical terms, any materials and any contingent sizes and shapes of the components may be used, according to need and the state of the art.

We claim:

1. A low-voltage circuit breaker comprising:

a containment structure;

a control mechanism;

a plurality of circuit breaking poles, each of which comprises a housing containing a sealed ampoule that in turn contains at least one fixed contact and at least one moving contact, which can be mutually coupled and uncoupled, said housing comprising a first side and a second side that define an interior containing said ampoule, an outer side wall on said first side being complementary to and associable with an outer side wall of said second side, said poles being located side-by-side to form a set of poles complementary to at least a part of said containment structure; and operative connection means between said control mechanism and said poles;

said control mechanism comprise a first drive shaft operatively connected to said operative connection means converting the rotatory movement of the drive shaft into a substantially linear translatory movement of the moving contact along a predefined axis, and comprise, for each pole a drive lever fixed to the drive shaft and operatively connected to the moving contact, and comprise a first connecting rod connected to a first connection point on said drive lever and to a first carriage for operating said moving contact; said first carriage comprises a sloping surface operatively coupled to the corresponding moving contact and suitable for converting a translatory movement of said first carriage into a translatory movement of the moving contact along a predefined axis.

2. A circuit breaker according to claim 1, wherein said sealed ampoule delineates an internal volume that is substantially a vacuum.

3. A circuit breaker according to claim 1, wherein said sealed ampoule delineates an internal volume that contains an arc extinguishing gas.

4. A circuit breaker according to claim 1, wherein said operative connection means comprise a second connecting rod that connects a first drive lever to a second lever for driving said moving contact.

5. A circuit breaker according to claim 4, wherein a second drive lever comprises a cam-shaped surface operatively coupled to said moving contact so that the rotation of said second lever determines a translatory movement of said moving contact along a predefined axis.

6. A circuit breaker according to claim 1, wherein said housing is made of an insulating material.

7. A circuit breaker according to claim 1, wherein said operative connection means comprise at least one element made of an insulating material.

* * * * *